United States Patent [19]

Blann

[11] 4,099,693

[45] Jul. 11, 1978

[54] CONTAINER SUPPORT

[76] Inventor: Ellis L. Blann, 213 Oak Leaf Dr., Wilmington, N.C. 28401

[21] Appl. No.: 734,825

[22] Filed: Oct. 22, 1976

[51] Int. Cl.[2] ..... E06C 7/14

[52] U.S. Cl. ..... 248/210; 248/311.1 R

[58] Field of Search ..... 248/210, 211, 214, 128, 248/311.1, DIG. 3; 182/129

[56] References Cited

U.S. PATENT DOCUMENTS

| | | | |
|---|---|---|---|
| 790,200 | 5/1905 | Foster | 248/210 |
| 1,283,160 | 10/1918 | Gross | 248/311.1 X |
| 2,912,204 | 11/1959 | Raysinger | 248/210 |
| 3,160,383 | 12/1964 | Lamm | 248/211 |
| 3,223,369 | 12/1965 | Benninger, Jr. | 248/210 |
| 3,756,679 | 9/1973 | Schoenfelder | 108/29 X |

FOREIGN PATENT DOCUMENTS

| | | | |
|---|---|---|---|
| 683,720 | 12/1952 | United Kingdom | 248/210 |

*Primary Examiner*—Roy D. Frazier
*Assistant Examiner*—Peter A. Aschenbrenner
*Attorney, Agent, or Firm*—Mills & Coats

[57] ABSTRACT

In abstract a preferred embodiment of this invention is a support for use in conjunction with hollow rung ladders. This support has an elongated portion adapted to pass through the hollow rungs with a retaining configuration on the end thereof. The opposite end has a container bail engaging projection with a container side support positioned therebelow.

6 Claims, 2 Drawing Figures

CONTAINER SUPPORT

Figure 2:
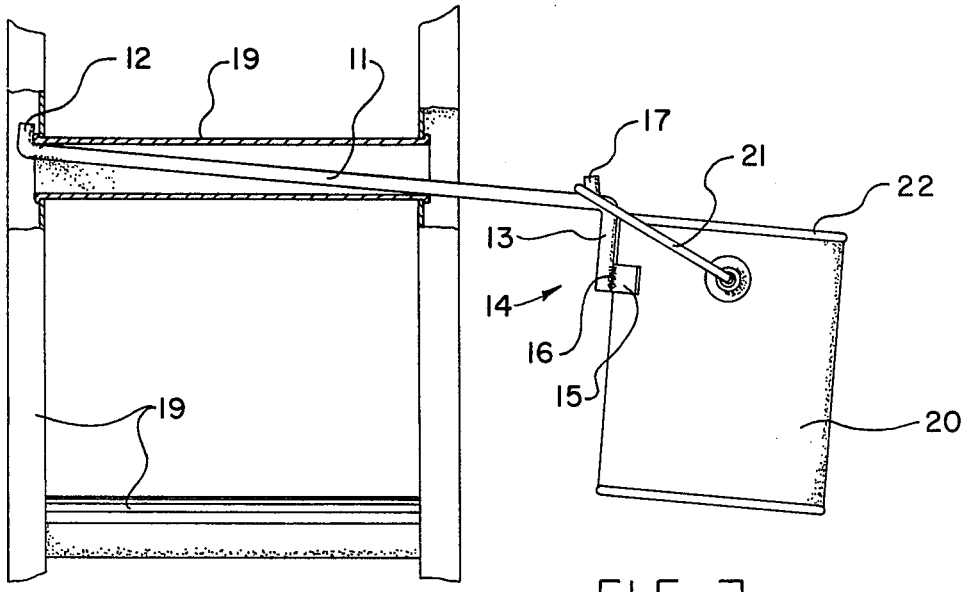

This invention relates to container supports and more particularly to devices for pivotably supporting a bucket type container in spaced relation to hollow rung type ladders.

In the past, various devices and contrivances have been devised or experimented with to hold a container adjacent a worker on a ladder. Probably the original and certainly today the simplest and most popular device is a wire coat hanger or old bucket bail bent in an "S" shape with one end engaging a rung of the ladder and the other end engaging the bail of the container. When water or detergent is contained in the container for washing windows or similar purposes, it may be satisfactory but when paint or similar liquid coatings are being used, the wire hook configuration becomes extremely undesirable at best. First the bucket, because of gravity, must be hung behind the ladder with the worker having to be a contortionist to even be able to get his brush or applicator therein. This causes not only excessive spillage but prevents the worker from properly scrapping his brush against the edge of the container which in turn will cause excessive dripping during application.

In recent years metal or aluminum type ladders have become very popular because of their light weight, nonwarping and nonrotting qualities. These ladders almost universally have hollow rungs with openings through the uprights thereof. Various types of means have been experimented with to connect containers to the rungs of aluminum type ladders including elongated members for insertion thereinto to more sophisticated devices including bail engaging means inside support brackets. None of these various devices have been successful either because their complexity placed them financially out of range of the average person or their configuration is so unstabled as to be impractical to use.

After much research and study into the above mentioned problems, the present invention has been developed to provide an extremely simple and yet highly efficient means for supporting a container adjacent a worker on an aluminum type ladder. This device includes an upturned end for insertion into and through a rung of the ladder with a container bail engaging hook on the other end thereof with a container engaging bracket therebelow. This places the container on the side of the ladder where it is readily accessible rather than behind it. Because of weight distribution, the present invention is self-leveling and gets the bail away from the top of the container thus giving practically the whole rim surface for removing excessive paint or other liquids from the applicator being used. Because of its simplicity, the present invention is affordable by anyone using a ladder and can even be given away as a promotional item if desired.

In view of the above, it is an object of the present invention to provide a container support which is extremely simple to produce and yet accomplishes a superior supportive effect.

Another object of the present invention is to provide a simple, inexpensive and yet highly efficient container support adapted to be used in conjunction with aluminum type ladders.

A further object of the present invention is to provide a container support which holds the bail of the container out of the way of the rim of the opening thereof.

An even further object of the present invention is to provide a container support which requires no mechanical operation for insertion, removal or use of the same.

Another object of the present invention is to provide a container support for use in conjunction with aluminum ladders that is self-leveling, is conveniently located and yet is inexpensive to produce.

Other objects and advantages of the present invention will become apparent and obvious from a study of the following description in the accompanying drawings which are merely illustrative of such invention.

IN THE DRAWINGS

Figure 1:
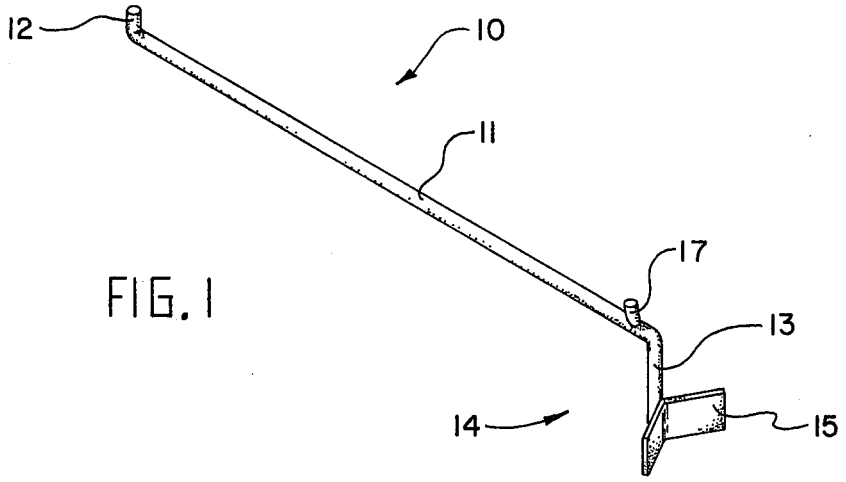

FIG. 1 is a perspective view of the container support of the present invention showing the various parts thereof; and FIG. 2 is a cutaway partial view of an aluminum type ladder with the container support of the present invention in operative position relative thereto.

With further reference to the drawings, a container support indicated generally at 10 includes an elongated portion 11. This elongated portion 11 is preferably formed from rod like stock such as three-eights inch diameter steel (although it is obvious that other materials could just as well be used).

One end of elongated portion 11 terminates in an upturned or hooked portion 12 preferably disposed at approximately 90° to the elongated portion.

The end of elongated portion 11 opposite said upturned portion 12 is downturned at approximately 90°. This downturned portion or end 13 forms the backbone of the container bracket portion indicated generally at 14. A flange 15 of either arcuate or angular surfaced configuration is fixedly secured to downturned portion 13. If metal is used, this flange can be secured by means such as weld 16 or can be secured by any other suitable means.

On the upper part (as oriented in the drawings), of elongated portion 11, slightly inwardly of the break or bend between such portion and downward portion 13 is a bail engaging member or stud 17. This bail engaging member is preferably welded as shown at 18 or otherwise formed as described. It is preferably disposed at approximately 90° to the longitudinal axis of elongated portion 11 and is adapted to holdingly engage the bail of a container as will hereinafter be described.

In use of the container support of the present invention, a ladder 18 is placed in the desired upright position which by necessity must be for all practical purposes vertical when viewed from the front and angular relative to vertical when viewed from the side.

The working height of the ladder is then selected and elongated portion 11 of support 10 passed through the hollow rung 19 of the ladder 18 until the upturned portion has passed completely through such rung. It can then be pulled back to the position shown in FIG. 2 and will engage the ladder upright to prevent the support from accidentally being removed from the rung. Even the vibration of a worker climbing up the ladder or even moving the ladder from one location to another has been found to be inadequate to accidentally jar the support from the rung once it is engaged and the container 20 is mounted thereon.

Next the bail normally found on containers of the type under consideration is moved to the side of the container in the approximate position shown in FIG. 2 and slid over bail engaging member 17. Holding pressure on the container can then be relaxed and it will assume its position shown in FIG. 2. In this position, the container bracket portion 14 with its flange 15 supports the side of container 20 with bail 21 firmly retaining the same. As can clearly be seen in FIG. 2, the weight of container 20 acts as the load end of a fulcrum to maintain hook portion 12 firmly in contact with the end of rung 19 opposite the side on which container 20 is mounted.

It is possible to move ladder 18 without removing the container support 10 and its associated container 20 therefrom and without spilling the contents thereof because of the gimbaled action of such container about the longitudinal axis of elongated portion 11. Should it be desired to remove the container, however, (such as when the ladder is moved some distance or the job has been completed) elongated portion 11 can be gripped adjacent bail engaging member 17 and the container support removed from rung 19 in same manner as it was inserted.

Because of the specific design of the present invention, even when container 20 is sat on a supportive surface, support 10 will not automatically release therefrom. The reason for this is that the weight of the elongated portion 11 presses down to maintain pressure of bracket portion 14 against the side of container 20. Because bail engaging member 17 is slightly angled off perpendicular to elongated portion 11, bail 21 will remain engaged therewith. Thus, it can be seen that a support and handle means is provided which will not fall off the container and become disengaged therefrom simply because the container is placed on a supportive surface. On the other hand when it is desired to again use the support of the present invention in relation to a ladder, container 20 can be carried by elongated portion 11 until it is again inserted into one of the rungs 19 of ladder 18.

Because of the specific design of the support of the present invention, bail 21 is maintained almost completely out of the way when in the supported position so that the rim 22 of the top opening of container 20 is unobstructed. This is a distinct advantage when painting with a brush since, if the brush is not pressed against the rim to allow excess paint thereof to drip back into the container, the brush will apply too much paint to the surface being coated and will also invariably drip when being moved from the container to the surface. Having the bail in the position shown gives complete access to the rim area for dipping and dedripping the brush. Also if container 20 is used for holding things such as tools for the worker (not shown) on the ladder 18, the fact that the open top of the container is unobstructed and is of great benefit.

In view, of the above, it is obvious that the present invention has the advantage of providing a simple, inexpensive and yet highly efficient container support which functions in a superior manner to prior known devices of the same general type. Not only can the support of the present invention support its associated container, but it also holds the container bail away from the open end of the container thus allowing easy access to the contents therein.

The terms "upturned", "downturned", and so forth have been used herein merely for convenience to describe the support and its parts as oriented in the drawings. It is to be understood, however, that these terms are in no way limiting to the invention since the support may obviously be disposed in many different positions when in actual use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A container support comprising: an aluminum type ladder having hollow rungs; an elongated rod-like member of relatively small diameter compared to the interior diameter of said hollow rungs; an upturned hook portion bent at an angle of approximately 90° forming one end of said elongated member and adapted to pass through a hollow rung of said ladder; a downturned bracket portion forming the end of said elongated portion opposite said hook portion whereby a Z-shaped member is provided; a bail engaging member provided on said elongated portion adjacent said bracket portion; and a container side engaging means provided adjacent the end of said bracket portion opposite said elongated member whereby a container support is provided for use in conjunction with said aluminum type ladder wherein the weight of said container on one end of said support will cause a positive locking effect between the opposite 90° upturned end portion and said ladder.

2. The support of claim 1 wherein the bracket portion is a bend in the elongated rod-like member of approximately 90°.

3. The support of claim 1 wherein the container side engaging means is a flange secured to the bracket portion.

4. The support of claim 3 wherein the flange is an angular member having adjacent flat surfaces.

5. The support of claim 3 wherein the flange is a concave member.

6. The support of claim 1 wherein the bail engaging member is a rod-like projection secured to said elongated portion.

* * * * *